US007302713B1

(12) United States Patent
Bhatt et al.

(10) Patent No.: US 7,302,713 B1
(45) Date of Patent: Dec. 4, 2007

(54) HANDS-FREE TOILET AND URINAL FLUSHING DEVICE

(76) Inventors: Harin G. Bhatt, 5075 Lakebrook Run, Stone Mountain, GA (US) 30087; Gargi H. Bhatt, 5075 Lakebrook Run, Stone Mountain, GA (US) 30087; Parashar H. Bhatt, 5075 Lakebrook Run, Stone Mountain, GA (US) 30087

( * ) Notice: Subject to any disclaimer, the term of this patent is extended or adjusted under 35 U.S.C. 154(b) by 371 days.

(21) Appl. No.: 11/051,154

(22) Filed: Feb. 7, 2005

(51) Int. Cl.
*E03D 5/00* (2006.01)

(52) U.S. Cl. ..... 4/249; 251/295; 74/512

(58) Field of Classification Search ..... 4/246.1–246.5, 4/249; 74/501.6, 512; 251/295; 200/342, 200/345

See application file for complete search history.

(56) References Cited

U.S. PATENT DOCUMENTS 2,204,867 A * 6/1940 Rehback ..... 74/512
5,120,923 A * 6/1992 Kato et al. ..... 200/342 X
5,319,996 A * 6/1994 Harris ..... 74/512 X
6,096,989 A * 8/2000 Kinoshita ..... 200/345

* cited by examiner

*Primary Examiner*—Robert M. Fetsuga
(74) *Attorney, Agent, or Firm*—Rodgers & Rodgers

(57) ABSTRACT

A toilet and urinal flushing device comprising a reciprocating pedal attached to a toilet handle with the pedal being reciprocated by means of a spring.

1 Claim, 2 Drawing Sheets

HANDS-FREE TOILET AND URINAL FLUSHING DEVICE

BACKGROUND OF THE INVENTION

The pervasive use of public toilets is becoming a major health issue with the possible transmission of serious diseases such as HIV, hepatitis, etc. by the undesirable hand contact with bacteria from a toilet handle. There are several different types of modern hands-free flushing systems including sound-activated, infrared, and photosensor flush activation technologies. These systems are quite expensive and prone to malfunction.

BRIEF SUMMARY OF THE INVENTION

According to this invention, a toilet and urinal flushing device comprises a reciprocating pedal attached to a toilet handle with the pedal being reciprocated by means of a compression spring. Activation is achieved by pressing downwardly on the pedal so as to rotate the handle to initiate a flushing operation.

DETAILED DESCRIPTION OF THE INVENTION

Figure 1:
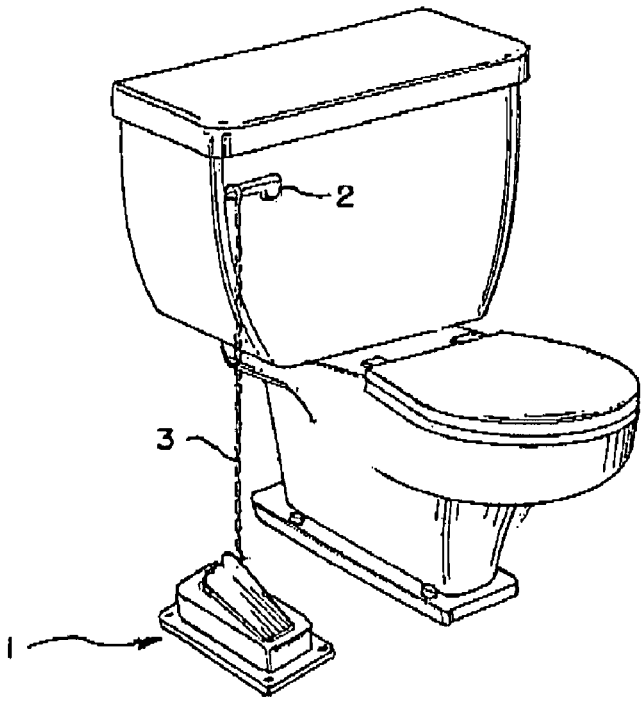
FIG. 1 is a perspective view of the flushing device according to this invention.
Figure 2:
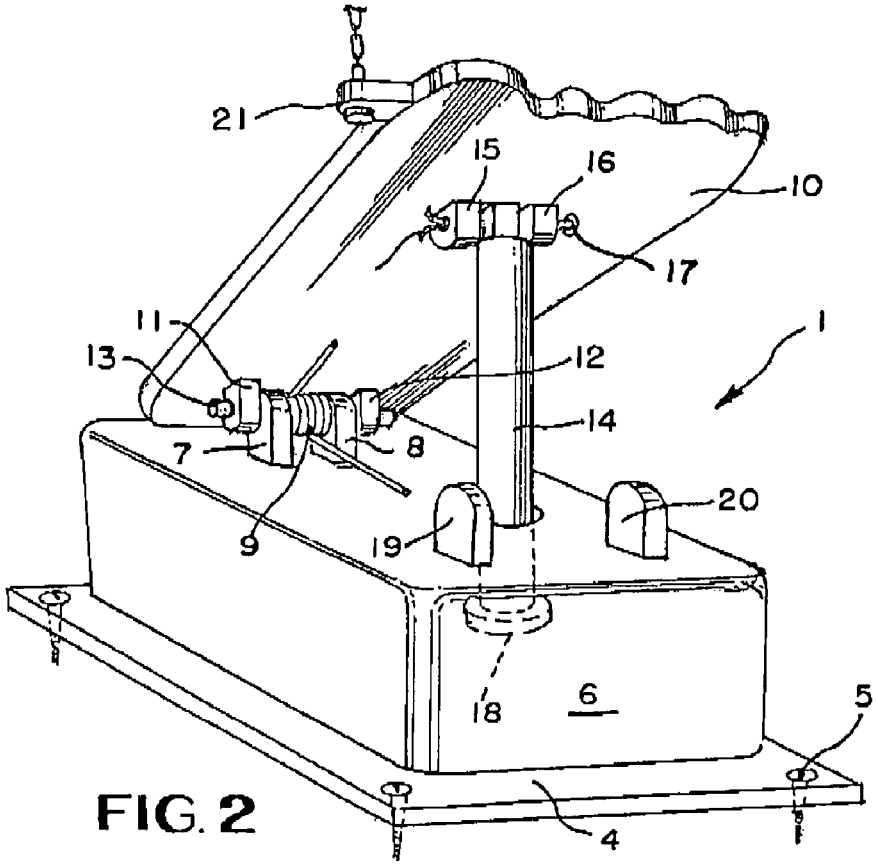
FIG. 2 is an enlarged perspective view of the flushing device.

In the drawings and with particular reference to FIG. 1, the flushing device according to this invention is indicated generally by the numeral 1 and which is attached to conventional toilet handle 2 by means of chain 3. In FIG. 2, flushing device 1 is shown and includes base plate 4 which is securable to the floor by means of multiple screws 5. Cover 6 is disposed on base plate 4 with studs 7 and 8 upstanding therefrom. In addition, V-type compression spring 9 is disposed between studs 7 and 8. Reciprocating pedal 10 is attached at one end to cover 6 by means of studs 11 and 12 which are secured to the bottom surface of pedal 10. Studs 7 and 8 are interconnected to studs 11 and 12 by means of rivet 13 which extends through apertures in studs 7, 8, 11 and 12 and through the center of spring 9, as shown in FIG. 2.

For the purpose of stabilizing pedal 10, rod 14 is secured to foot pedal 10 remote from spring 9 by means of studs 15 and 16 which are attached to the bottom surface of pedal 10 and which, in turn, are attached to the upper end of rod 14 by means of rivet 17 which extends through apertures formed in studs 15 and 16 and the upper end of rod 14, as shown in FIG. 2. Stop 18 is formed on the lower end of rod 14 to limit the upward movement of pedal 10. Also, studs 19 and 20 are formed on the upper surface of cover 6 to limit the downward movement of pedal 10. Finally, chain 3 is attached to pedal 10 by means of an interconnection with apertured tab 21.

Figure 3:
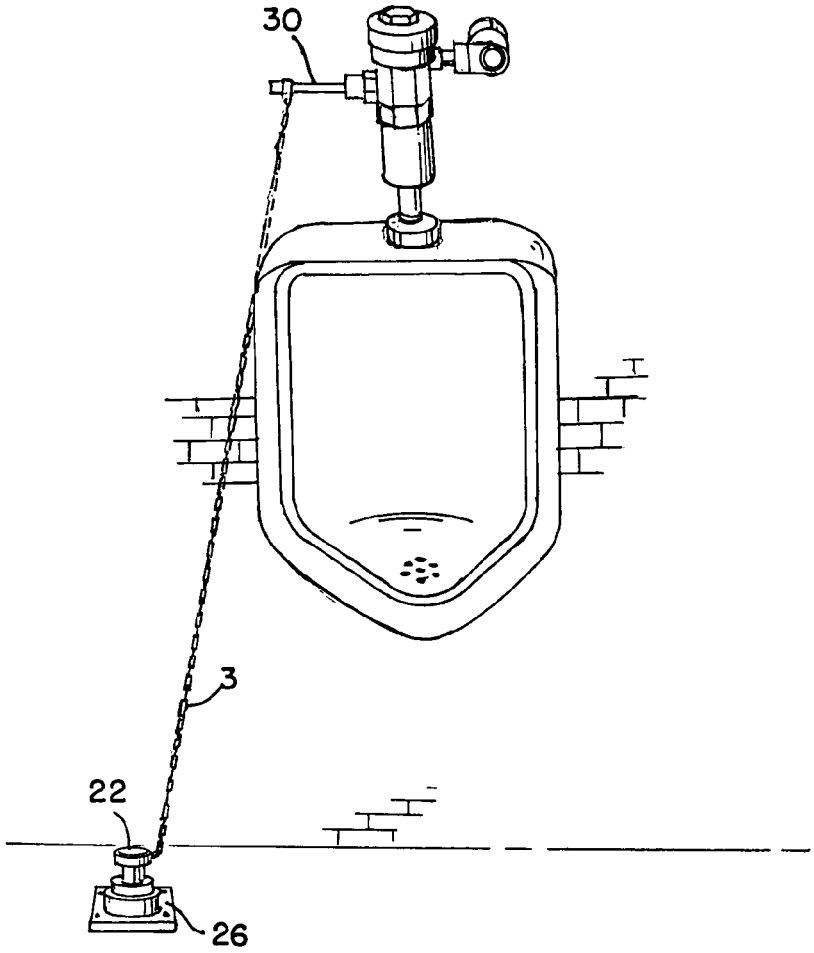
FIG. 3 depicts an alternate use of the device.
Figure 4:
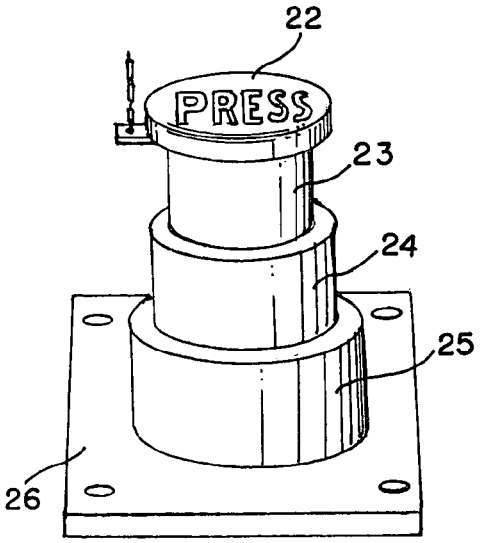
FIG. 4 shows an enlarged view of an alternative flushing activation means.
Figure 5:
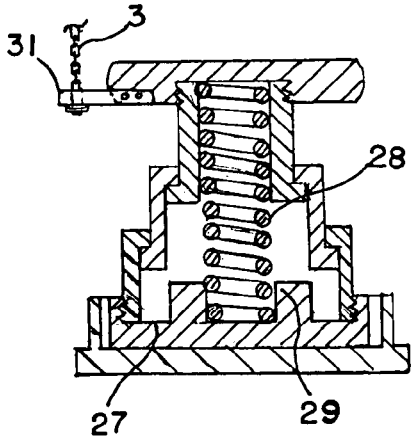
FIG. 5 is a cross-sectional view of the device shown in FIG. 4.

Alternative activation means is shown in FIGS. 3, 4 and 5 wherein pedal 22 is secured atop telescoping cylinders 23, 24 and 25 with lower cylinder 25 being attached to base plate 26.

As shown in FIG. 5, stabilizing plate 27 is disposed in face contacting relation with the top surface of base plate 26 and is adapted to receive compression spring 28 with the lower end of compression spring 28 being disposed within cylinder 29 uprising from stabilizing plate 27. Finally chain 3 is attached to urinal handle 30 by means of an interconnection with apertured tab 31.

Therefore, in operation, the user simply utilizes a foot to press onto either pedal 10 or 22 thereby causing the toilet or urinal handle to rotate downwardly counterclockwise by means of tension from chain 3 which causes the flushing operation to be initiated. Following this, spring 9 causes pedal 10 to rotate upwardly or spring 28 causes pedal 22 to rise vertically.

Therefore, by this invention, a toilet or urinal flushing device is provided which is simple, economical, and reliable. Most importantly, the possibility of disease transmission by hand contact with a toilet or urinal handle is eliminated.

The invention claimed is:

1. A flushing device comprising a base plate, a pedal reciprocal with respect to said base plate by means of a compression spring, said pedal being attachable to a toilet or urinal, three vertically disposed telescoping cylinders disposed on said base plate, said pedal disposed atop said cylinder remote from said base plate, said compression spring being disposed within said telescoping cylinders to urge said pedal upwardly, a stabilizing plate disposed on said base plate, said compression spring disposed on said stabilizing plate, a cylinder disposed inside the lower most one of said cylinders and extending upwardly from said stabilizing plate, and the lower end of said compression spring being disposed in said cylinder, an apertured tab extending from said pedal and a chain adapted to interconnect a handle and said apertured tab.

* * * * *